US008301044B2

(12) United States Patent
Hamaya et al.

(10) Patent No.: US 8,301,044 B2
(45) Date of Patent: Oct. 30, 2012

(54) IMAGE FORMING DEVICES INCLUDING ELECTRIFICATION CONTROL UNITS

(75) Inventors: Masahito Hamaya, Aichi (JP); Katsumi Inukai, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 390 days.

(21) Appl. No.: 12/568,380

(22) Filed: Sep. 28, 2009

(65) Prior Publication Data

US 2010/0080592 A1 Apr. 1, 2010

(30) Foreign Application Priority Data

Sep. 26, 2008 (JP) ..... 2008-248594

(51) Int. Cl.
*G03G 15/02* (2006.01)

(52) U.S. Cl. ..... 399/31

(58) Field of Classification Search ..... 399/31, 399/50, 170

See application file for complete search history.

(56) References Cited

U.S. PATENT DOCUMENTS

| | | | | |
|---|---|---|---|---|
| 6,029,018 | A * | 2/2000 | Rogers et al. | 399/12 |
| 7,634,202 | B2 * | 12/2009 | Kitazawa et al. | 399/9 |
| 7,986,889 | B2 * | 7/2011 | Hamaya | 399/31 |
| 2007/0147858 | A1 | 6/2007 | Inukai | |

FOREIGN PATENT DOCUMENTS

| | | | |
|---|---|---|---|
| JP | H5-033158 | U | 4/1993 |
| JP | H5-313439 | A | 11/1993 |
| JP | H9-190870 | A | 7/1997 |
| JP | H9-258528 | A | 10/1997 |
| JP | 2003-295537 | A | 10/2003 |
| JP | 2007-178595 | A | 7/2007 |

OTHER PUBLICATIONS

Japan Patent Office; Notification of Reasons for Rejection in Japanese Patent Application No. 2008-248594 mailed on Aug. 31, 2010.

* cited by examiner

*Primary Examiner* — David Gray
*Assistant Examiner* — Gregory H Curran
(74) *Attorney, Agent, or Firm* — Baker Botts L.L.P.

(57) ABSTRACT

An image forming device includes plural electrostatic latent image holding bodies that hold, on surfaces thereof, electrostatic latent images to be developed with developers of multiple colors, respectively, plural electrification control units that face the electrostatic latent image holding bodies and charge or discharge the surfaces of the electrostatic latent image holding bodies, respectively, a current controller that controls electric currents, each of which is supplied between the electrostatic latent image holding body and the electrification control unit for a corresponding one of the multiple colors, to be a constant target current, a maximum voltage output unit that outputs a maximum voltage among voltages each of which is applied between the electrostatic latent image holding body and the electrification control unit for a corresponding one of the multiple colors, and a detector that detects malfunction of the electrification control units when the maximum voltage exceeds a predetermined value.

7 Claims, 3 Drawing Sheets

IMAGE FORMING DEVICES INCLUDING ELECTRIFICATION CONTROL UNITS

CROSS-REFERENCE TO RELATED APPLICATION

This application claims priority under 35 U.S.C. §119 from Japanese Patent Application No. 2008-248594 filed on Sep. 26, 2008. The entire subject matter of the application is incorporated herein by reference.

BACKGROUND

1. Technical Field

The following description relates to one or more image forming devices configured to form an image on a recording sheet by forming an electrostatic latent image on an electrostatic latent image holding body corresponding to each of multiple colors, forming a developer image with the electrostatic latent image being developed with developer of each color, and transferring the developer image of each color onto the recording medium.

2. Related Art

So far an image forming device has been known, which includes a plurality of electrostatic latent image holding bodies respectively provided for multiple colors, a plurality of electrification control units respectively disposed to face the electrostatic latent image holding bodies and respectively configured to electrostatically charge or discharge surfaces of the corresponding electrostatic latent image holding bodies, an electrostatic latent image forming unit configured to form respective electrostatic latent images on the surfaces of the electrostatic latent image holding bodies charged or discharged by the electrification control units, a plurality of development units configured to form respective developer images by developing, with developers of the multiple colors, the electrostatic latent images formed on the surfaces of the electrostatic latent image holding bodies by the electrostatic latent image forming unit, and a transfer unit configured to sequentially transfer, onto a recording sheet, the developer images respectively formed on the surfaces of the electrostatic latent image holding bodies.

In the known image forming device configured as above, the multiple electrification control units electrostatically charge or discharge the surfaces of the multiple electrostatic latent image holding bodies provided for the multiple colors, respectively. Then, the electrostatic latent image forming unit forms the electrostatic latent images on the respective surfaces of the electrostatic latent image holding bodies. Onto the electrostatic latent image formed on the surface of each electrostatic latent image holding body, a corresponding color of developer is attached by the development unit, and thus the developer image is formed on the surface of each electrostatic latent image holding body. The developer images are sequentially transferred onto the recording sheet by the transfer unit, and thus an intended image is formed on the recording medium.

Additionally, in the known image forming device of this kind, which, for instance, has a corona discharge wire configured to evenly charge the surface of each electrostatic latent image holding body, there is a problem that arc discharge might be caused when the corona discharge wire is seriously contaminated. Therefore, a technique has been proposed which is adapted to detect voltage variation while supplying high voltage of a constant current to the corona discharge wire, and to reel the corona discharge wire as being seriously contaminated when the voltage variation exceeds a predetermined reference value, and to use a new corona discharge wire.

SUMMARY

However, when the above configuration is applied to a color image forming device, and a unit for detecting the above voltage variation and a unit for determining whether the voltage variation exceeds the predetermined reference value are provided individually for the electrostatic latent image holding body of each color, it needs a circuit configured in a complicated manner.

Aspects of the present invention are advantageous to provide one or more improved image forming devices that make it possible to detect, with a simple configuration, malfunction of a plurality of electrification control units respectively configured to electrostatically charge or discharge the surfaces of electrostatic latent image holding bodies.

According to aspects of the present invention, an image forming device is provided to perform image formation by transferring, onto a recording sheet, developer images respectively formed with electrostatic latent images developed with developers of multiple colors. The image forming device includes a plurality of electrostatic latent image holding bodies configured to hold, on surfaces thereof, the electrostatic latent images to be developed with the developers of the multiple colors, respectively, a plurality of electrification control units configured to face the electrostatic latent image holding bodies and to charge or discharge the surfaces of the electrostatic latent image holding bodies, respectively, a current controller configured to control electric currents, each of which is supplied between the electrostatic latent image holding body and the electrification control unit for a corresponding one of the multiple colors, to be a constant target current, a maximum voltage output unit configured to output a maximum voltage corresponding to a maximum absolute value among voltages each of which is applied between the electrostatic latent image holding body and the electrification control unit for a corresponding one of the multiple colors, and a detector configured to detect malfunction of the electrification control units when the maximum voltage output by the maximum voltage output unit exceeds a predetermined value.

In some aspects of the present invention, each of the voltages applied between the respective electrostatic latent image holding bodies and the respective electrification control units that correspond to the multiple colors is not compared with the predetermined value in order to detect the malfunction of the electrification control units. Alternatively, the maximum voltage output by the maximum voltage output unit depending on the maximum absolute value among the voltages is compared with the predetermined value. Thus, the image forming device can be configured in a more simplified manner.

BRIEF DESCRIPTION OF THE ACCOMPANYING DRAWINGS

FIG. 1 schematically shows an internal configuration of an image forming device in an embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

[Overall Configuration of Image Forming Device]

Figure 1:
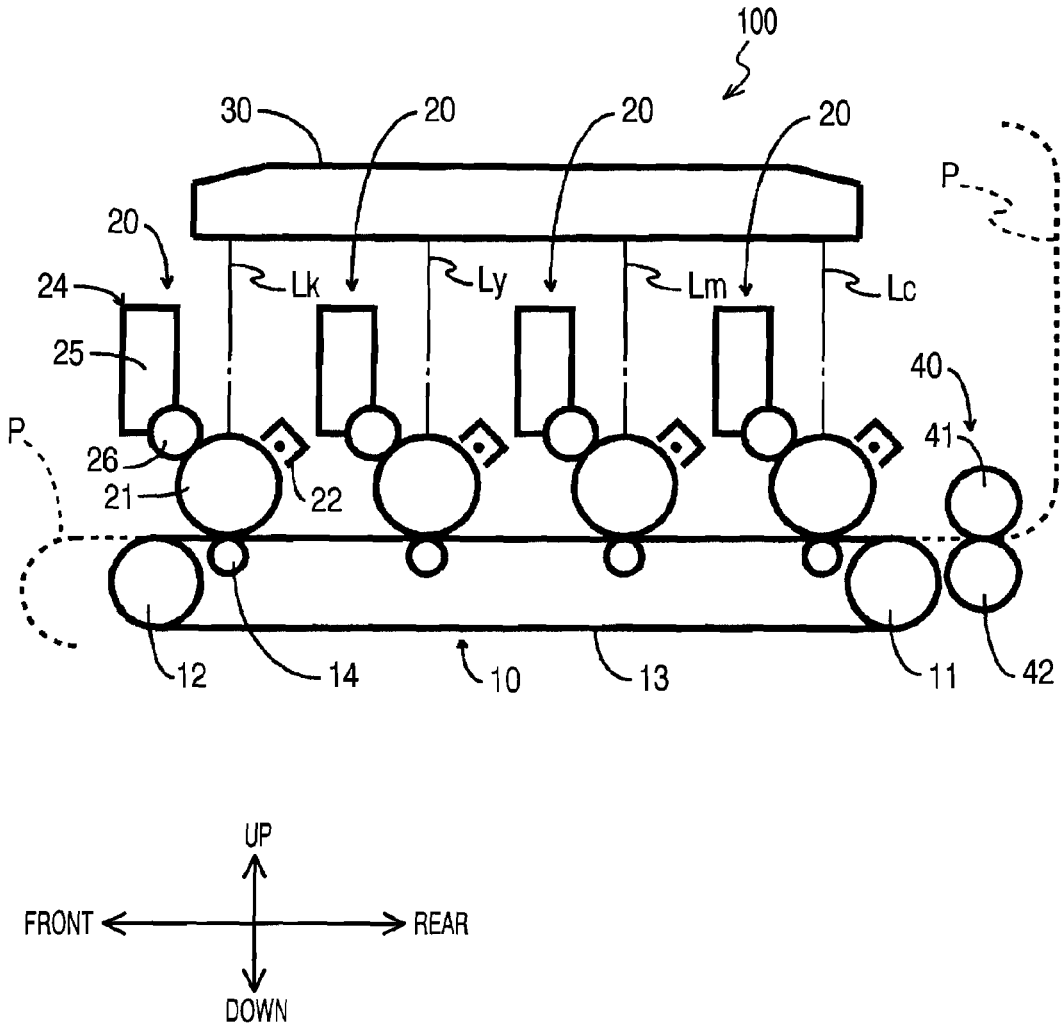

Hereinafter, an embodiment according to aspects of the present invention will be described with reference to the accompany drawings. FIG. 1 schematically shows an internal configuration of an image forming device 100 in an embodiment according to aspects of the present invention. It is noted that the following description will be given with the left side in FIG. 1 defined as the front side of the image forming device 100.

As illustrated in FIG. 1, the image forming device 100 of the embodiment includes a belt unit 10 configured with a feeding belt (transfer belt) 13 wound around a driving roller 11 and a driven roller 12, and four process units 20, corresponding to four colors of black (K), yellow (Y), magenta (M), and cyan (C), respectively, which are disposed above the belt unit 10. The four process units 20 are aligned in a front-to-rear direction in the order of the black (K), yellow (Y), magenta (M), and cyan (C) from the front side, and thus configured as a direct tandem color image forming unit.

Each of the process units 20 is configured with a photoconductive drum 21, a charger 22, and a development cartridge 24. The photoconductive drum 21 includes a metal drum body connected to ground with a surface thereof covered with a positively-electrifiable photoconductive layer.

The charger 22 is disposed a predetermined distance away from the photoconductive drum 21, at an obliquely upper rear side of the photoconductive drum 21, so as to face the photoconductive drum 21. The charger 22 is a scorotron charger configured to cause an electrification wire 22A thereof (see FIG. 2) such as a tungsten wire to generate corona discharge and to charge the surface of the photoconductive drum 21 positively and evenly. The development cartridge 24 has a toner container 25 provided therein. The development cartridge 24 is a known one configured to positively charge, in a frictional manner, one-component positively-electrifiable nonmagnetic toner of a corresponding one color of the black (K), cyan (C), magenta (M), and yellow (Y), which is stored in the toner container 25 and to supply the toner to the photoconductive drum 21 via a development roller 26.

Further, the belt unit 10 has four transfer rollers 14 provided to face the photoconductive drums 21 across the feeding belt 13, respectively. The feeding belt 13 is driven to turn in the clockwise direction in FIG. 1 by clockwise rotation of the driving roller 11. A sheet P is fed onto the surface of the feeding belt 13 by various rollers (not shown) such as a feed roller, from a feed tray (no shown) inserted into a lower portion of the image forming device 100. Then, the sheet P is conveyed to the rear side of the image forming device 100, passing through a position to face each photoconductive drum 21.

A scanner unit 30 is provided above the process units 20. The scanner unit 30, which is a known one configured to scan and expose the photoconductive drums 21, includes semiconductor lasers (not shown) configured to emit laser beams Lk, Ly, Lm, and Lc corresponding to four colors of image data, respectively, and polygon mirrors (not shown) configured to deflect the laser beams L (Lk, Ly, Lm, and Lc), respectively.

Therefore, first, the surface of each photoconductive drum 21 is charged evenly and positively by the charger 22 while being rotating. Thereafter, the surface of the photoconductive drum 21 is exposed through high-speed scanning of the laser beam L emitted by the scanner unit 30, and thus an electrostatic latent image, which corresponds to an image to be formed on the sheet P, is formed on the surface of the photoconductive drum 21. Subsequently, the positively charged toner held on the development roller 26 is supplied to the electrostatic latent image formed on the surface of the photoconductive drum 21 through rotation of the development roller 26 when facing and contacting the photoconductive drum 21. Thereby, the electrostatic latent image on the photoconductive drum 21 is developed into a visible image as a toner image formed with the toner attached to exposed portions on the surface of the photoconductive drum 21.

After that, the toner image held on the surface of each photoconductive drum 21 is sequentially transferred onto the sheet P by a negative transfer bias applied to the transfer roller 14 under constant current control when the sheet P being conveyed by the feeding belt 13 passes between the photoconductive drum 21 and the transfer roller 14. Next, the sheet P with the toner transferred thereon in this manner is conveyed to a fixing unit 40 provided behind the belt unit 10.

The fixing unit 40 includes a heating roller 41 that is provided with a heat source and configured to be rotated, and a pressing roller 42 that is disposed below the heating roller 41 so as to face and press the heating roller 41 and configured to be rotated in accordance with rotation of the heating roller 41. The fixing unit 40 heats the sheet P with four colors of toner images formed thereon while pinching and conveying between the heating roller 41 and the pressing roller 42, and thus thermally fixes the toner images on the sheet P. Then, the sheet P with the toner images thermally fixed thereon is ejected by various rollers (not shown) onto a catch tray (not shown) provided on an upper surface of the image forming device 100.

[Configuration of Power Supply Circuit for Charger]

Figure 2:
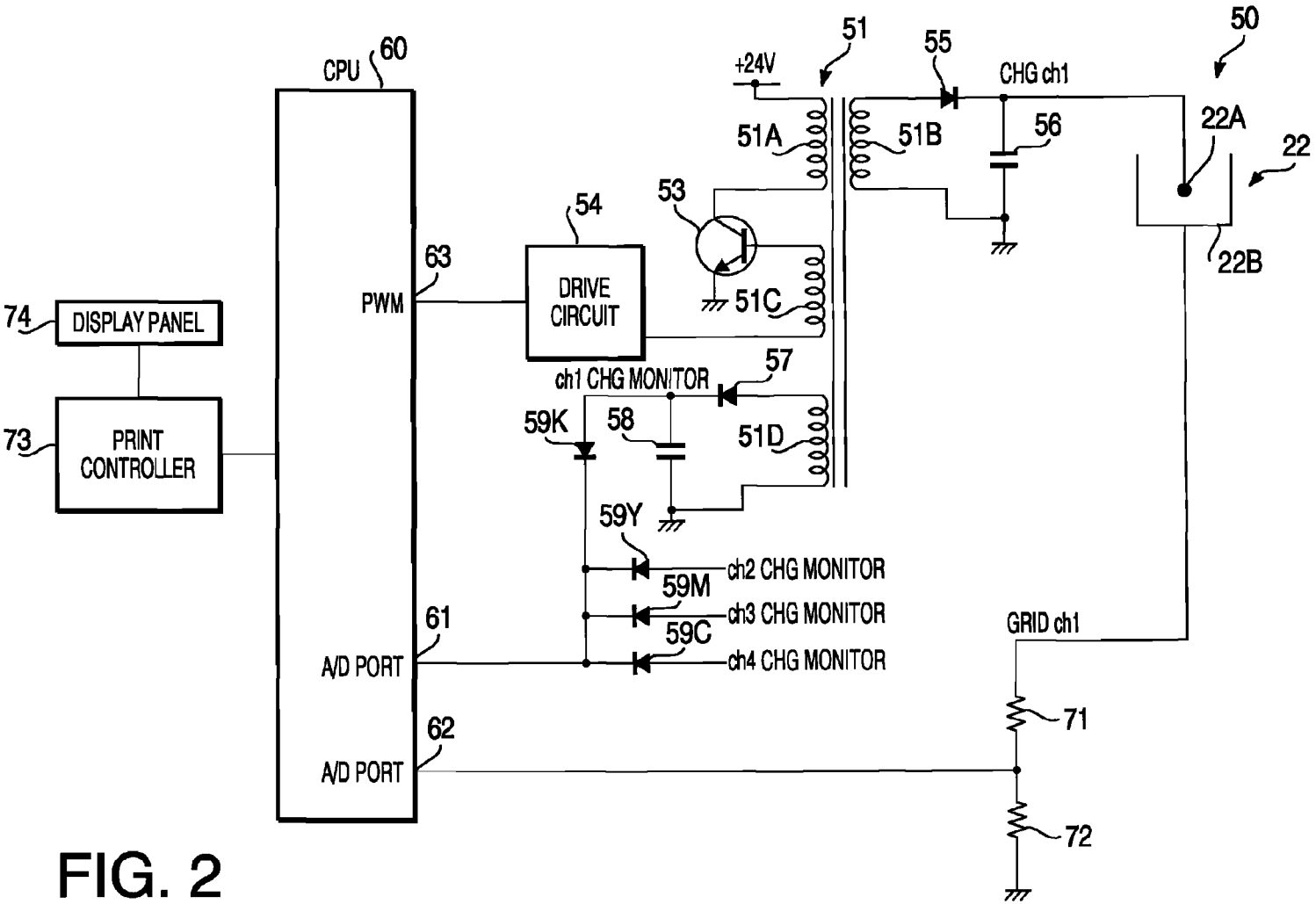
FIG. 2 is a block diagram showing a configuration of a power supply circuit for electrification of the image forming device in the embodiment according to one or more aspects of the present invention.

FIG. 2 is a block diagram showing a configuration of a power supply circuit 50 to supply electricity to the charger 22. It is noted that FIG. 2 mainly shows a configuration of a circuit for the color of black (K). In the following description, channels ch1, ch2, ch3, and ch4 are assigned to the black (K), yellow (Y), magenta (M), and cyan (C), respectively.

As illustrated in FIG. 2, the power supply circuit 50 includes a transformer 51 configured such that energy stored in a primary coil 51A thereof by electricity supplied by a direct-current power source of 24 V is transmitted to a secondary coil 51B thereof by a back electromotive force, a transistor 53 configured to switch the current to be supplied to the primary coil 51A, and a drive circuit 54 configured to control a base current of the transistor 53. An auxiliary coil 51C of the transformer 51 is provided between the base of the transistor 53 and the drive circuit 54. The voltage generated in the secondary coil 51B is controlled as follows, depending on the voltage to be output based on a below-mentioned PWM signal.

Specifically, when the base current is generated in the transistor 53 through the auxiliary coil 51C by a voltage output from the drive circuit 54, the transistor 53 is set ON and a collector current flows from the direct-current power source via the primary coil 51A. Thereby, the magnetic flux of the transformer 51 is increased. Since the collector current does not become equal to or more than an upper-limit current value amplified based on a gain of the transistor 53, the collector current of the transistor 53 is saturated. Therefore, the magnetic flux supplied by the primary coil 51A stops to increase, and an electric potential between both ends of the auxiliary coil 51C is reduced. Then, the base current of the transistor 53 decreases and the transistor 53 is rapidly set OFF. At this time, due to the back electromotive force of the transformer 51, the energy stored in the transformer 51 is transmitted to the secondary coil 51B, and a voltage is generated and elevated in the secondary coil 51B.

A rectifier diode 55 is series-connected to the secondary coil 51B. Further, a smoothing condenser 56 is connected in parallel to both ends of a series circuit that includes the secondary coil 51B and the diode 55. Then, from a high-voltage side of the secondary coil 51B, an electrification output CHG ch1 is supplied to the electrification wire 22A of the charger 22. It is noted that it is not shown in FIG. 2, but electrification outputs CHG ch2, CHG ch3, and CHG ch4 are supplied to the electrification wires 22A of the chargers 22 corresponding to the colors, yellow (Y), magenta (M), and cyan (C) via similar circuits separately provided with the transformers 51, respectively.

Further, the transformer 51 is provided with a detection coil 51D connected with a rectifier diode 57 and a smoothing condenser 58 in a manner similar to the secondary coil 51B. An output voltage at a high-voltage side of the detection coil 51D, which rises or falls depending on a voltage applied to the electrification wire 22A, is input as a "ch1 CHG monitor" to an A/D port 61 of a CPU 60 via a diode 59K. It is noted that it is not shown in FIG. 2, but output voltages at high-voltage sides of the detection coils 51D of the transformers 51 corresponding to the colors, yellow (Y), magenta (M), and cyan (C) are input as a "ch2 CHG monitor," a "ch3 CHG monitor," and a "ch4 CHG monitor" to the A/D port 61 of the CPU 60 via diodes 59Y, 59M, and 59C, respectively.

The four diodes 59K, 59Y, 59M, and 59C are connected to the A/D port 60 with their respective cathodes connected with each other. The maximum voltage (corresponding to the maximum absolute value) among the "ch1 CHG monitor" to the "ch4 CHG monitor" is input to the A/D port 61.

The charger 22 has a grid 22B connected to ground via resistors 71 and 72. A current which flows from the grid 22B via the resistors 71 and 72 rises and falls depending on the rise and fall of a current which flows between the electrification wire 22A and the photoconductive drum 21. Therefore, as illustrated in FIG. 2, a voltage between the resistors 71 and 72 that correspond to the black (K) is input to an A/D port 62 of the CPU 60. A voltage between the resistors 71 and 72 that correspond to each of the other colors is input to another A/D port (not shown) of the CPU 60 in the same manner.

By reference to the voltages, the CPU 60 issues a PWM signal to the drive circuit 54 corresponding to each color via a PWM port 63, such that an electric potential of the grid 22B (hereinafter referred to as a grid voltage GRID ch1) reveals a predetermined value. When each of the drive circuits 54 outputs a voltage depending on the PWM signal, the voltage generated in the secondary coil 51B varies as mentioned above. Here, the grid voltage GRID ch1 varies depending on the current flowing via the resistors 71 and 72, thus depending on the current supplied between the charger 22 and the photoconductive drum 21.

Further, the CPU 60 is connected with a print controller 73 configured to control image formation (hereinafter, also referred to as printing) by each process unit 20 or the scanner unit 30 as a whole. Furthermore, the print controller 73 is linked with a display panel 74 provided on a surface of a housing (not shown) of the image forming device 100.

Control in the Embodiment

Subsequently, a process to be executed by the CPU 60 will be described. The CPU 60 performs a process shown in a flowchart of FIG. 3 based on a program stored on a built-in ROM. Hereinafter, the process will be set forth.

Figure 3:
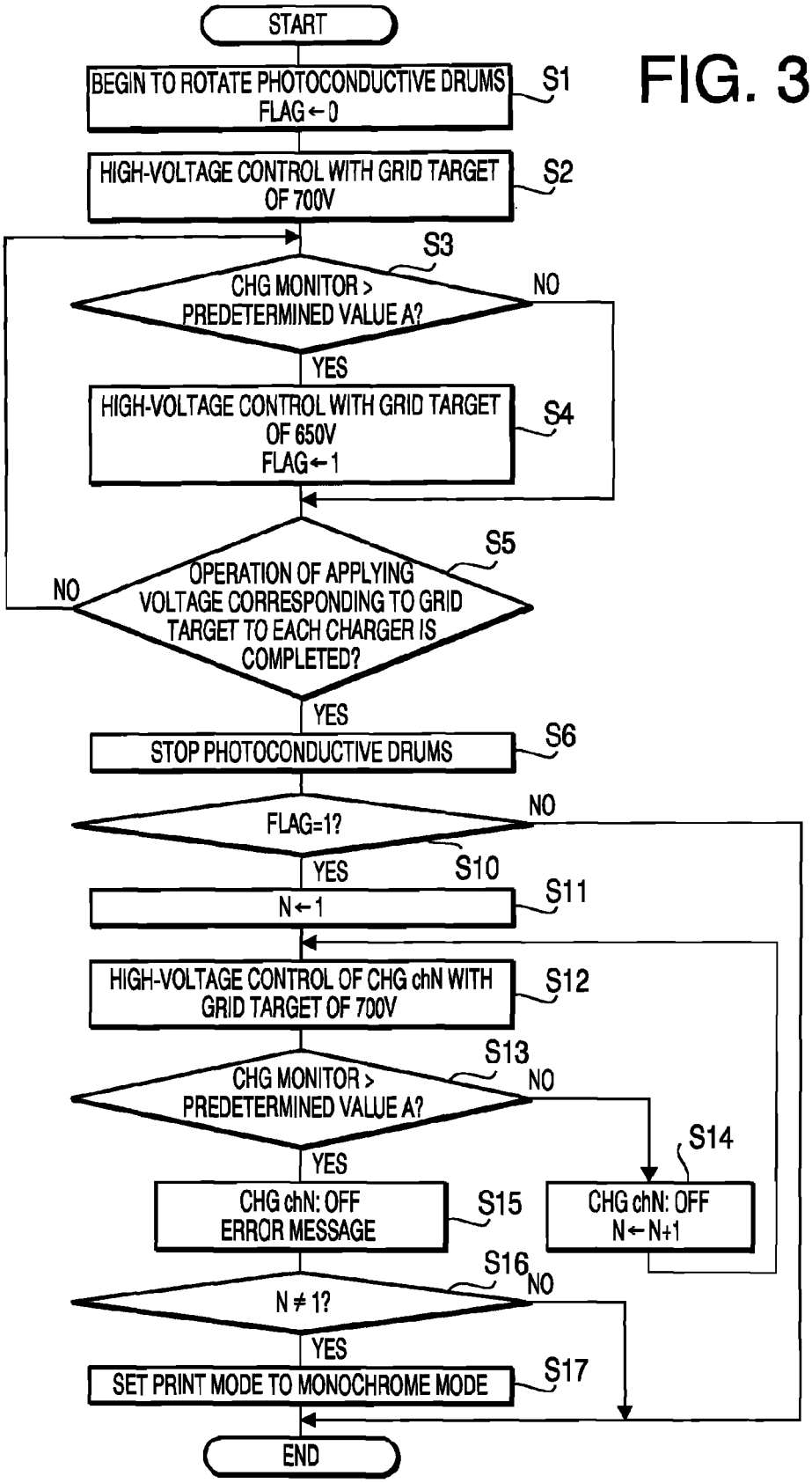
FIG. 3 is a flowchart showing a process to be executed for the power supply circuit for electrification in the embodiment according to one or more aspects of the present invention.

As illustrated in FIG. 3, in the process, the CPU 60 first begins to rotate each photoconductive drum 21 via the print controller 73, and at the same time, resets a flag to be used in a below-mentioned process to "0" (S1). In a subsequent step S2, the CPU 60 begins to take control of the PWM signal (voltage control) corresponding to each color under a target value (GRID target) of 700 V for the grid voltages GRID ch1 to GRID ch4 (S2). Further, in S3, the CPU 60 determines whether a "CHG monitor" (the maximum voltage of the "ch1 CHG monitor" to the "ch4 CHG monitor" is over a predetermined value A (S3). It is noted that the predetermined value A is set to a voltage at which the arc discharge might occur between the charger 22 and the photoconductive drum 21.

When the "CHG monitor" is more than the predetermined value A (S3: Yes), the CPU 60 begins to take the voltage control under the GRID target changed to 650 V and sets the flag to "1" (S4). Then, the CPU 60 advances to S5. In addition, when the "CHG monitor" is equal to or less than the predetermined value A (S3: No), the CPU 60 goes directly to S5 from S3. In S5, the CPU 60 determines whether an operation of applying a voltage corresponding to the GRID target to each charger 22 is completed (S5). When the operation of applying a voltage corresponding to the GRID target to each charger 22 is not completed (S5: No), the CPU 60 goes to the aforementioned step of S3. Meanwhile, when the operation of applying a voltage corresponding to the GRID target to each charger 22 is completed (S5: Yes), the CPU 60 proceeds to S6, in which the photoconductive drum 21 corresponding to each color is stopped (S6).

In S10 subsequent to S6, the CPU 60 determines whether the flag is set to "1." When the flag is set to "0" (S10: No), the present process is once terminated. Meanwhile, when the flag is set to "1" (S10: Yes), a parameter N is set to "1" (S11). In a subsequent step S12, the CPU 60 takes control of an charge output CHG chN under a GRID target of 700 V (S12). Further, in S13, the CPU 60 determines whether the "CHG monitor" (in this case, which corresponds to the "chN CHG monitor" is over the predetermined value A (S13). When the "CHG monitor" is equal to or more than the predetermined value A (S13: No), the CPU 60 set the charge output CHG chN OFF and increments the parameter N by one (S14), and thereafter goes to the aforementioned step of S12. Then, the CPU 60 executes S12 and the following steps with the parameter N incremented by one. It is noted that the values 1 to 4 for the parameter N (N=1-4) correspond to the black (K), yellow (Y), magenta (M), and cyan (C), respectively.

S11 and the following steps are performed when the "CHG monitor" as the maximum number of the "ch1 CHG monitor" to the "ch4 CHG monitor" is over the predetermined value A (S3: Yes). Therefore, while the steps of S12 to S14 are performed with the parameter N being increased from 1 (N=1) to 4 (N=4), the "CHG monitor" becomes over the predetermined value A (S13: Yes) without failure. Then, the CPU 60 goes to S15, in which the charge output CHG chN is set OFF and an error message is displayed on the display panel 74 to inform that something is wrong with the charger 22 of a color corresponding to the parameter N at that time.

In a subsequent step S16, the CPU 60 determines whether a condition "N≠1" is satisfied (S16). When the parameter N is equal to "1" (N=1) (S16: No), it means that the charger 22 corresponding to the black (K) is abnormal, and the present process is once terminated in the state of the image forming device 100 impossible to work after the aforementioned error message is given. When the parameter N is not equal to "1" (N≠1) (S16: Yes), it means that the charger 22 corresponding to a color other than the black (K) is abnormal, and a print mode is set to a monochrome mode (S17) to allow the print controller 73 to perform printing with only the toner of black (K).

Effects of the Embodiment

As described above, in the embodiment, the maximum value of the "ch1 CHG monitor" to the "ch4 CHG monitor" is detected via the four diodes 59K, 59Y, 59M, and 59C with the cathodes thereof connected with each other, and the detected value (CHG monitor) is compared with the predetermined value A (S3). Therefore, it can present more simplified configuration than achieved in the case where each of the "ch1 CHG monitor" to the "ch4 CHG monitor" is compared with the predetermined value A. Further, at first, only the "CHG monitor" as the maximum value of the "ch1 CHG monitor" to the "ch4 CHG monitor" is compared with the predetermined value A (S3), and when no abnormality is detected (S10: No), the present process is terminated. Meanwhile, when the maximum value reveals an abnormal value (S10: Yes), it is determined to which color an abnormal charger 22 corresponds (S11 to S14). Hence, it is possible to reduce a processing load in the case of no abnormality detected, and it is possible to specify an abnormal one of the four chargers 22 when abnormality is detected in the determination of S10. Furthermore, since the steps of S11 to S14 are executed in the state where the photoconductive drums 21 are stopped (S6), the influences that the steps have on other structures can be kept to the minimum.

Further, when the "CHG monitor" is over the predetermined value A, the GRID target is reduced to 650 V (S4). Thus, it is possible to prevent the arc discharge from occurring. Moreover, the display panel 74 displays thereon which color an abnormal charger 22 corresponds to (S15). Thus, a user can clean or replace the abnormal charger 22. Furthermore, when the abnormal charger 22 corresponds to a color other than the black (K) (S16: Yes), the print mode is set to the monochrome mode (S17). Therefore, even though color printing is not available, it is possible to perform monochrome printing.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of its versatility are shown and described in the present disclosure. It is to be understood that the present invention is capable of use in various other combinations and environments and is capable of changes or modifications within the scope of the inventive concept as expressed herein. For example, the following modifications are possible.

Modifications

The electrostatic latent image may be formed in a method for exposure using LEDs or a method other than exposure. Further, each electrostatic latent image holding body may be a belt. Furthermore, aspects of the present invention may be applied to an image forming device configured to transfer a developer image attached onto the surface of each electrostatic latent image holding body onto an intermediate transfer body and then to transfer the developer image on the intermediate transfer body onto a recording sheet. In the aforementioned embodiment, aspects of the present invention are applied to the chargers 22. However, aspects of the present invention may be applied to dischargers configured to discharge the surfaces of the electrostatic latent image holding bodies, respectively.

What is claimed is:

1. An image forming device configured to perform image formation by transferring, onto a recording sheet, developer images respectively formed with electrostatic latent images developed with developers of multiple colors, comprising:

a plurality of electrostatic latent image holding bodies configured to hold, on surfaces thereof, the electrostatic latent images to be developed with the developers of the multiple colors, respectively;

a plurality of electrification control units configured to face the electrostatic latent image holding bodies and to charge or discharge the surfaces of the electrostatic latent image holding bodies, respectively;

a current controller comprising a plurality of drive circuits corresponding to the plurality of electrification control units, the current controller being configured to independently control electric currents, each of which is supplied between the electrostatic latent image holding body and the electrification control unit for a corresponding one of the multiple colors via a corresponding one of the plurality of drive circuits, to be a constant target current;

a maximum voltage output unit configured to receive a plurality of voltages applied between the plurality of electrostatic latent image holding bodies and the plurality of electrification control units and output a maximum voltage corresponding to a maximum absolute value from among the plurality of voltages; and a detector configured to detect malfunction of the electrification control units when the maximum voltage output by the maximum voltage output unit exceeds a predetermined value.

2. The image forming device according to claim 1, further comprising a specifying unit to specify an electrification control unit that causes the malfunction detected by the detector, wherein, in response to the malfunction of the electrification control units detected by the detector during the image formation on the recording sheet, after the image formation, the specifying unit causes the current controller to sequentially control the electric current, supplied between the electrostatic latent image holding body and the electrification control unit that correspond to each of the multiple colors, to be the target current, and wherein the specifying unit specifies the electrification control unit that causes the malfunction by sequentially comparing, with a predetermined value, maximum voltages output by the maximum voltage output unit while the current controller sequentially control the electric currents between the electrostatic latent image holding bodies and the electrification control units.

3. The image forming device according to claim 1, further comprising a target current reducing unit configured to, when the detector detects the malfunction of the electrification control units, reduce the target current for the electric currents to be controlled by the current controller.

4. The image forming device according to claim 2, further comprising a target current reducing unit configured to, when the detector detects the malfunction of the electrification control units, reduce the target current for the electric currents to be controlled by the current controller.

5. The image forming device according to claim 2, further comprising a display unit configured to display information regarding the electrification control unit specified by the specifying unit.

6. The image forming device according to claim 2, wherein the multiple colors include a black, and wherein the image forming device further comprises a print mode setting unit configured to, when the electrification control unit specified by the specifying unit corresponds to a color other than the black, set a print mode to a monochrome mode in which the image formation is performed only with the developer of the black.

7. An image forming device configured to perform image formation by transferring, onto a recording sheet, developer images respectively formed with electrostatic latent images developed with developers of multiple colors, comprising:

a first electrostatic latent image holding body configured to hold, on surfaces thereof, a first electrostatic latent image to be developed with developer of a first color;

a second electrostatic latent image holding body configured to hold, on surfaces thereof, a first second electrostatic latent image to be developed with developer of a second color;

a first electrification control unit configured to face the first electrostatic latent image holding body and to charge or discharge the surfaces of the first electrostatic latent image holding body;

a second electrification control unit configured to face the second electrostatic latent image holding body and to charge or discharge the surfaces of the second electrostatic latent image holding body;

a current controller comprising:

a first drive circuit configured to control electric currents, which are supplied between the first electrostatic latent image holding body and the first electrification control unit, to be a first constant target current, and a second drive circuit configured to control electric currents, which are supplied between the second electrostatic latent image holding body and the second electrification control unit, to be a second constant target current; and a malfunction detector comprising:

a single voltage detector, a first voltage monitor coupled to the single voltage detector via a first diode, and a second voltage monitor coupled to the single voltage detector via a second diode, wherein the malfunction detector is configured to detect malfunction of at least one of the first and second electrification control units when a voltage detected by the single voltage detector exceeds a predetermined value.

* * * * *